US008096629B2

(12) United States Patent
Halfon et al.

(10) Patent No.: US 8,096,629 B2
(45) Date of Patent: Jan. 17, 2012

(54) SYSTEM FOR POSITIONING SLIDING DOORS

(75) Inventors: Amos Halfon, Sitriya (IL); Mordechai Harari, Rishon Lezion (IL)

(73) Assignee: Hardoor Mechanism Productions Ltd., Rishon Lezion (IL)

( * ) Notice: Subject to any disclaimer, the term of this patent is extended or adjusted under 35 U.S.C. 154(b) by 805 days.

(21) Appl. No.: 12/094,201

(22) PCT Filed: Nov. 29, 2006

(86) PCT No.: PCT/IL2006/001377

§ 371 (c)(1),
(2), (4) Date: May 19, 2008

(87) PCT Pub. No.: WO2007/063541

PCT Pub. Date: Jun. 7, 2007

(65) Prior Publication Data

US 2008/0302016 A1 Dec. 11, 2008

(51) Int. Cl.
*E05D 15/06* (2006.01)

(52) U.S. Cl. ..... 312/349; 312/319.7; 49/209

(58) Field of Classification Search ..... 49/209–211, 49/221, 223, 225; 312/139.2, 349, 350, 304, 312/301, 319.5–319.8

See application file for complete search history.

(56) References Cited

U.S. PATENT DOCUMENTS

| | | | | | |
|---|---|---|---|---|---|
| 2,445,131 | A * | 7/1948 | Wartian | 244/129.5 |
| 4,565,031 | A | 1/1986 | Sakamoto | |
| 4,574,524 | A * | 3/1986 | Bonetti et al. | 49/130 |
| 4,644,690 | A * | 2/1987 | Caimi | 49/130 |
| 4,708,410 | A * | 11/1987 | Mazaki | 312/138.1 |
| 5,031,975 | A * | 7/1991 | Anderson | 312/319.7 |
| 5,287,653 | A | 2/1994 | Young | |
| 5,711,112 | A * | 1/1998 | Barten et al. | 49/118 |
| 6,052,944 | A * | 4/2000 | Louda | 49/212 |
| 6,543,865 | B1 * | 4/2003 | Louda | 312/114 |
| 7,219,950 | B2 * | 5/2007 | McDonald et al. | 296/155 |
| 7,647,728 | B2 * | 1/2010 | Bortoluzzi | 49/209 |
| 7,845,116 | B2 * | 12/2010 | Masuda | 49/223 |
| 7,849,633 | B2 * | 12/2010 | Oshima et al. | 49/209 |
| 2005/0005524 | A1 * | 1/2005 | Berry et al. | 49/209 |
| 2006/0225356 | A1 * | 10/2006 | Jarolim | 49/209 |

* cited by examiner

*Primary Examiner* — Janet M Wilkens

(74) *Attorney, Agent, or Firm* — The Law Office of Michael E. Kondoudis

(57) ABSTRACT

Presented herein is a novel sliding door system that that enables adjustment of at least two sliding doors relative to each other such that surfaces of the sliding doors create a substantially flush surface a support onto which the sliding door mechanism is mounted. The system includes at least one inner and outer sliding door slidably coupled to corresponding guide rails. The guide rail that is coupled to the outer sliding door is selectably moveable by a sliding door mechanism between a first and a second position. In the first position, a user can slide outer and inner sliding doors along said guide rails, whereas in the second position, a surface of the outer sliding door is substantially flush with a surface of said inner sliding door.

17 Claims, 18 Drawing Sheets

SYSTEM FOR POSITIONING SLIDING DOORS

FIELD OF INVENTION

This invention relates generally to sliding doors, and specifically to such doors that reside substantially in substantially the same plane when fully closed.

BACKGROUND OF THE INVENTION

Many cabinets, and other enclosed containers, are equipped with sliding doors. While such configurations are quite convenient to operate, this design is inherently flawed. In order to allow the doors to slide freely, the doors must be set on different planes. Accordingly, when the doors are fully closed, there is a gap that allows dust, moisture, and other undesirable material to enter into the cabinet. Furthermore, the same gap makes it hard to adequately secure the cabinet. And the separate doors are not aesthetically appealing.

Attempts have been made in the art to provide a solution to these flaws by providing sliding doors that use various means to move the doors into substantially the same plane. For example, U.S. Pat. No. 4,565,031, EP0124196, and U.S. Pat. No. 5,287,653 all disclose sliding door arrangements that allow the doors to slide substantially parallel to one another. In addition to the usual substantially parallel movement of the sliding doors, such attempts in the art also require the user manipulation that involves transverse and/or lateral movement as well as. EP0193504 discloses a similar device that relies on a plurality of springs, a feature that makes the operation of the device less accurate because the user must know exactly where to apply pressure in order to move the second door into substantially the same plane as the first door. Furthermore, the multitude of pieces and components that are used by such solutions make them very susceptible to breakage and constant maintenance.

Thus, it is an objective of the present invention to overcome the shortcomings of the art, and also provide a simple, cost-effective system for aligning sliding doors on substantially the same plane.

SUMMARY OF SOME EMBODIMENTS OF THE INVENTION

In embodiments of the invention, the system includes at least one inner and outer sliding door slidably coupled to corresponding guide rails. The guide rail that is coupled to the outer sliding door is selectably moveable by a sliding door mechanism between a first and a second position. In the first position, a user can slide outer and inner sliding doors along the guide rails, whereas in the second position, a surface of the outer sliding door is substantially flush with a surface of the inner sliding door.

In embodiments of the invention, the mechanism includes at least one rod rotatably affixed to the support, which may be any type of cabinet.

In embodiments of the invention, the rod has a thread onto which an annular device is threaded, which may be a nut, a mortise and the like.

In embodiments of the invention, the annular device is fixedly adjusted to the outer guide rail. Rotation of the rod causes longitudinal displacement of the annular device along the thread, thereby causing a longitudinal displacement of the outer sliding door.

In embodiments of the invention, the direction of movement of said annular device in the thread depends on the rotational direction of the rod.

In embodiments of the invention, the rod is rotated by a drive, which is comprised of at least one of the following group: a belt drive and a cogwheel drive.

In embodiments of the invention, the belt drive includes at least one belt wrapped around the rotating drive.

In embodiments of the invention, the drive is operable by at least one of the following means: manually; electrically; pneumatically; and hydraulically.

In embodiments of the invention, the inner and outer guide rails have grooves that accommodate inner and outer sliding doors, respectively.

In embodiments of the invention, the inner and outer guide rails are substantially parallel to each other.

In embodiments of the invention, a hanging hardware couples the outer sliding door to the outer guide rail.

In embodiments of the invention, the hanging hardware includes a bridge element that extends up and over the inner door and the inner guide rail.

In embodiments of the invention, an activation switch is operatively associated with the drive such that the drive retracts the outer door into the second position upon an activation of the activation switch.

In embodiments of the invention, the mechanism includes a) at least one bearing having an inner and an outer ring, wherein the outer ring is affixed to the support; b) a first rod suitably coupled to a displacement drive and rotatably connected to the inner ring; and c) a second rod suitably coupled to the outer guide rails and rotatably connected to the inner ring. Operating the displacement drive enables the rotation of the inner ring to selectably move the outer sliding door into the first and the second position.

In embodiments of the invention, inner rings of a plurality of the bearings securely hold therein a rod such that enabling the displacement drive to rotate the plurality of bearings.

In embodiments of the invention, the bearing has a protrusion substantially aligned with the second rod to confining upward movement of the second rod to prevent detachment of the outer guide rail from the support.

In embodiments of the invention, the displacement drive is operable by at least one of the following means: manually; electrically; pneumatically; and hydraulically.

In embodiments of the invention, the displacement drive enables selectable displacement of the first rod into a closing and opening position. The displacement of the first rod into the closing position causes the inner ring to rotate in a direction causing the second rod and the outer guide rail which is connected thereto to retract to the second position. The displacement of the first rod into the opening position causes the inner ring to rotate in a direction causing the second rod and the outer guide rail to be pushed outwardly to the first position.

BRIEF DESCRIPTION OF THE DRAWINGS

The subject matter regarded as the invention will become more clearly understood in light of the ensuing description of embodiments thereof, given by way of example only, with reference to the accompanying drawings, wherein.

Figure 1:
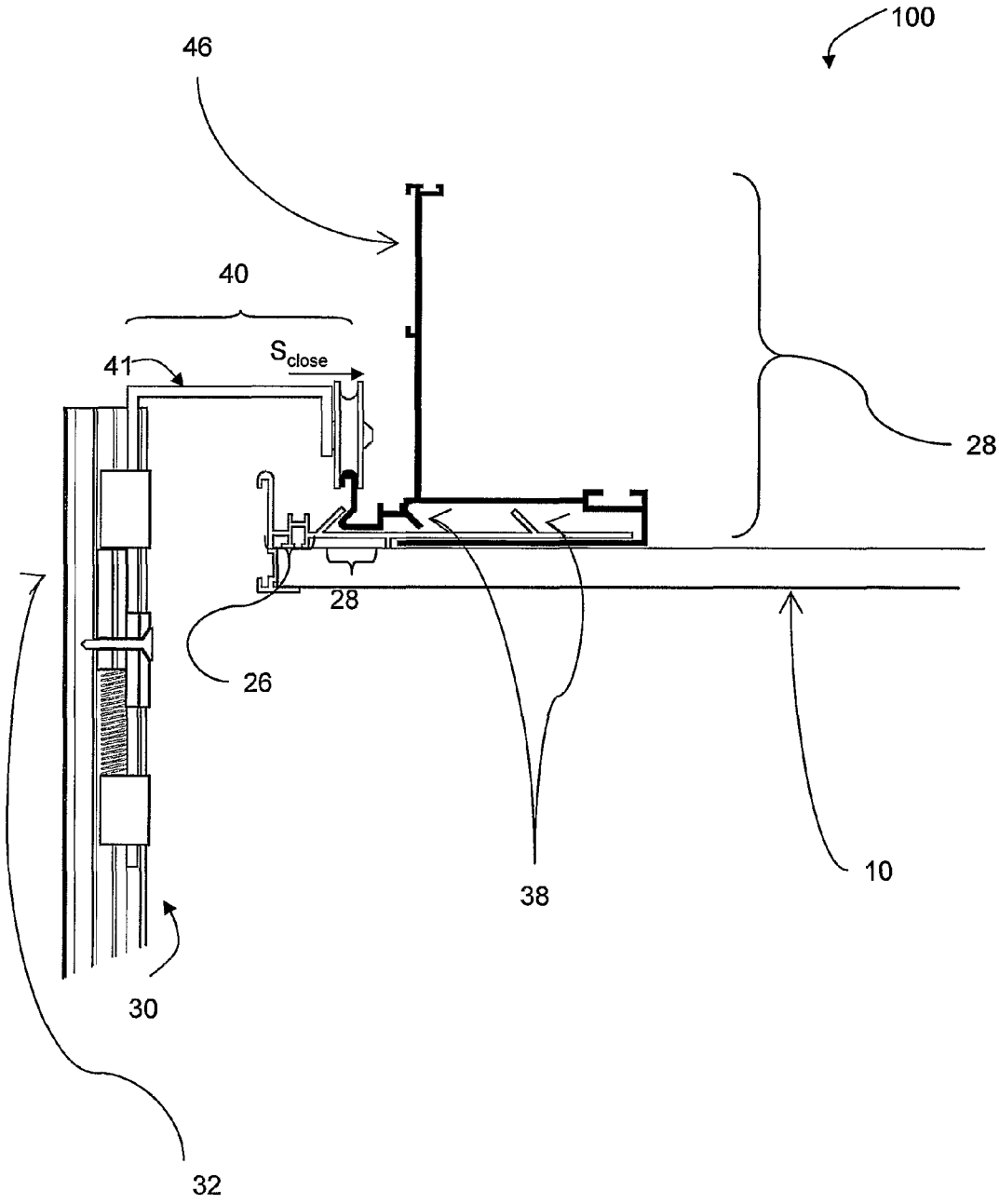
FIG. 1 is a detailed side view of a sliding door system affixed on a cabinet, according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF SOME EMBODIMENTS OF THE INVENTION

An embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions.

It is understood that the phraseology and terminology employed herein is not to be construed as limiting and is for descriptive purpose only.

The principles and uses of the teachings of the present invention may be better understood with reference to the accompanying description, figures and examples.

It is to be understood that the details set forth herein do not construe a limitation to an application of the invention. Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, integers or groups thereof and that the terms are not to be construed as specifying components, features, steps or integers.

The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element.

It is to be understood that where the claims or specification refer to "a" or "an" element, such reference is not to be construed as there being only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Where applicable, methods of the present invention may be implemented by performing or completing manually, automatically, or a combination thereof, selected steps or tasks.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

The terms "bottom", "below", "top" and "above" as used herein do not necessarily indicate that a "bottom" component is below a "top" component, or that a component that is "below" is indeed "below" another component or that a component that is "above" is indeed "above" another component. As such, directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Presented herein is a novel system (hereinafter referred to as "sliding door system") that enables adjustment of at least two sliding doors relative to each other such that surfaces of the sliding doors create a substantially flush surface. The sliding door system may be used for securely closing sliding doors of a cabinet or other container, which provides increased security, enhanced aesthetic value, and allows the more effective exclusion of moisture and dust by allowing the sliding doors to mechanically move from two separate planes to a single plane. This goal may be achieved by using a drive that is adapted to move the guide rails of at least one of the sliding doors. For example, sliding doors may comprise of an inner and an outer door, and the drive may be adapted to cause the rail of, e.g., the outer door to move towards or away from the cabinet and, consequently, into or out of substantially the same plane as, for example, the inner door. When the guide rails of the outer and inner doors are not on substantially the same plane, the sliding doors operate like any sliding doors. However, once the guide rails of the outer door are moved into substantially the same plane as the inner guide rails, there may be substantially no gap between the inner and the outer doors and the inner and outer doors create a substantially flush surface. It is to be understood that in some embodiments of the invention, inner and outer guide rails can be in different planes but still create a substantially flush surface with inner and outer doors.

Because the edges of the doors are on substantially the same plane, they create a substantially contiguous surface, and the sliding doors may no longer slide freely. By using mechanical means to move the one of the guide rails, there may be the option of introducing further security features, such as a lock, to prevent unwanted movement of the outer guide rails.

It is to be understood that the sliding door system may be adapted to a plurality of sliding doors, thereby enabling the positioning of two or more sliding doors on a single plane.

Because the present invention comprises very few moving parts, it is very sturdy and less susceptible to breakage. Furthermore, the present invention is inexpensive to manufacture. Another cost saving feature is that no special training or experience is necessary for installing the present invention. Operating the present invention is quite intuitive, and no particular preparation is required.

Figure 2:
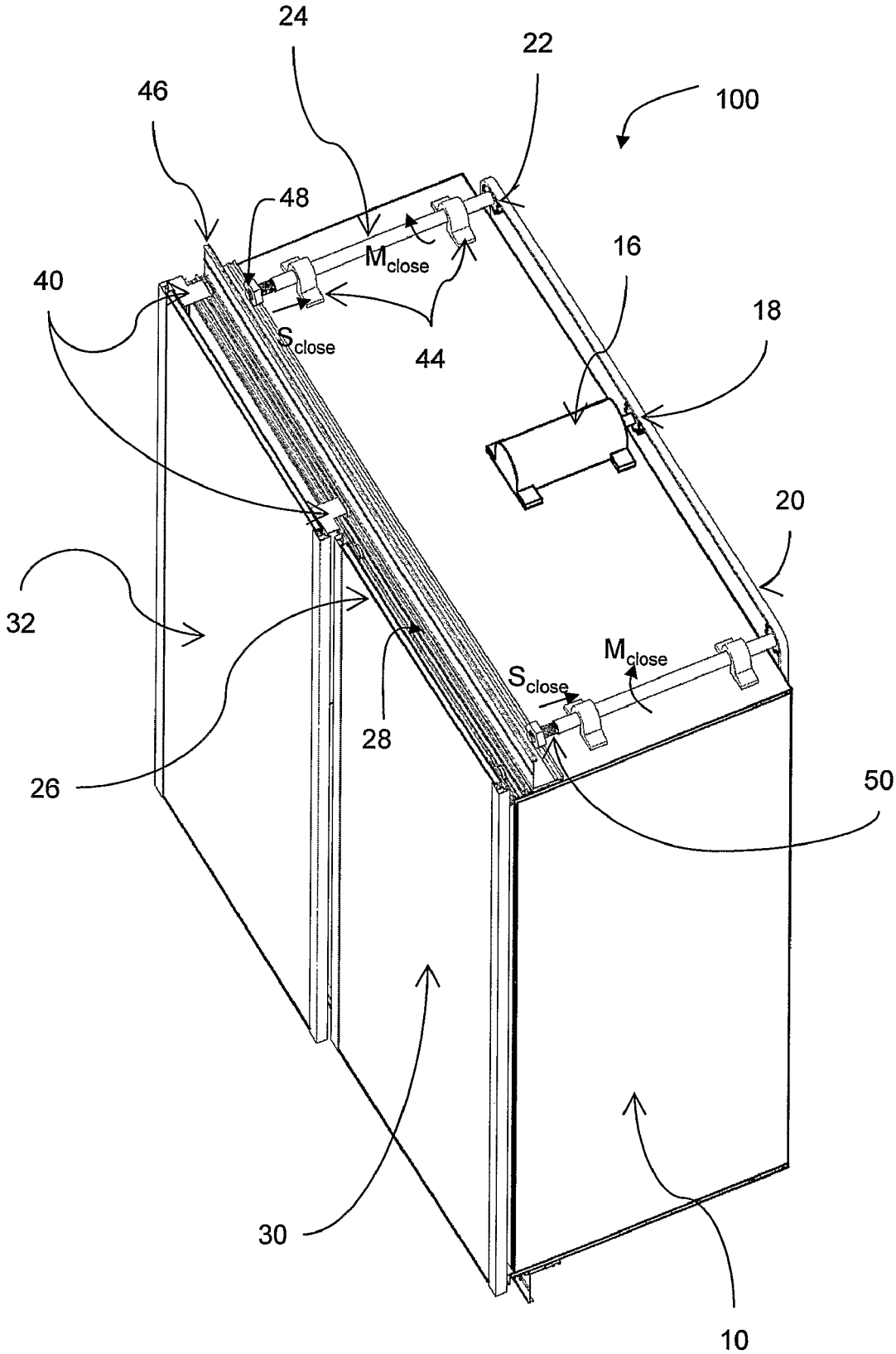
FIG. 2 is an isometric view of the sliding door system of the cabinet closed by sliding doors and wherein surfaces thereof that face the outside of the cabinet are not flush, according to an embodiment of the invention.
Figure 3:
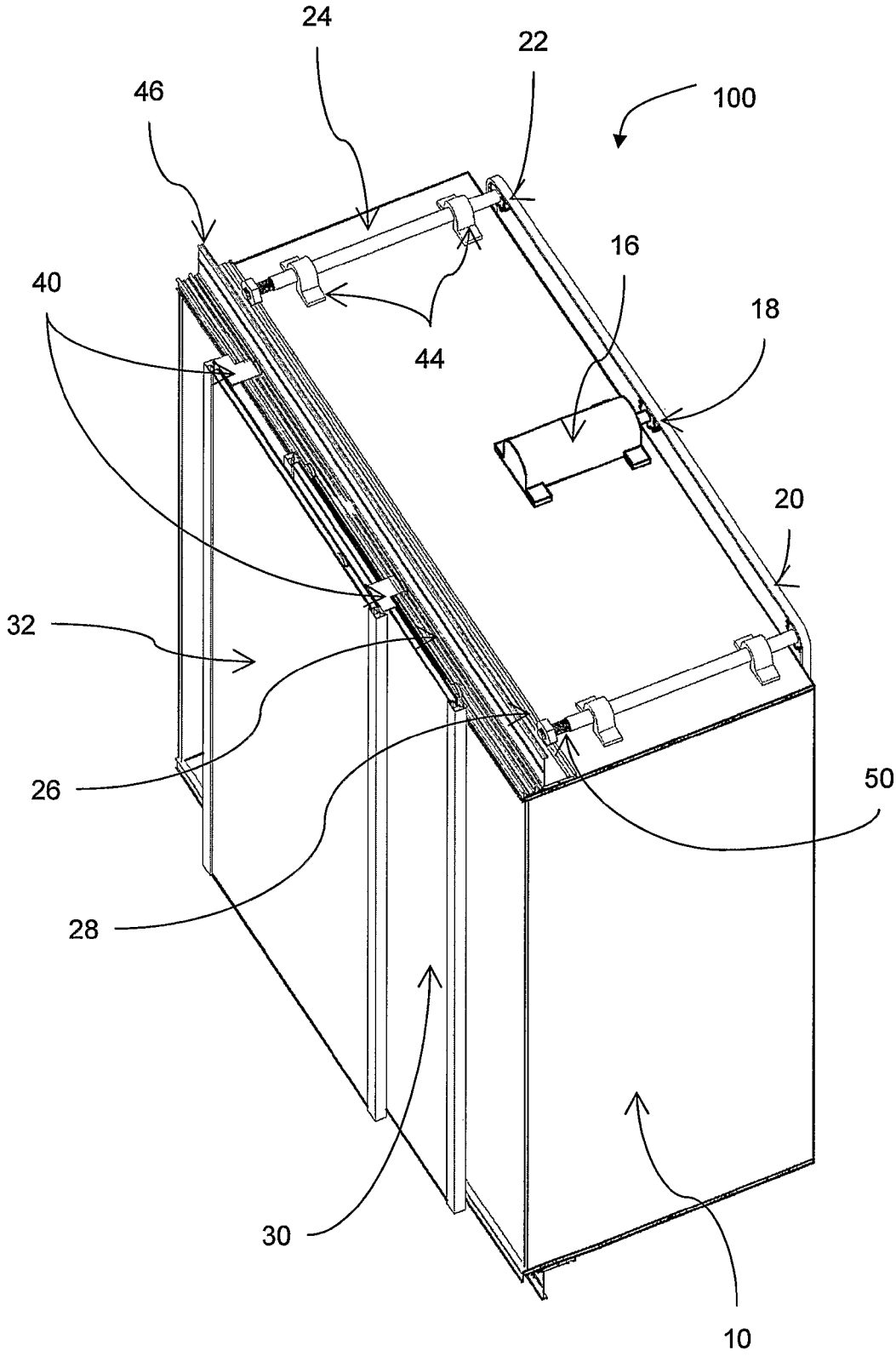
FIG. 3 is an isometric view of the sliding door system of the cabinet opened by the sliding doors, wherein surfaces thereof that face the outside of the cabinet are not flush, according to an embodiment of the invention.
Figure 4:
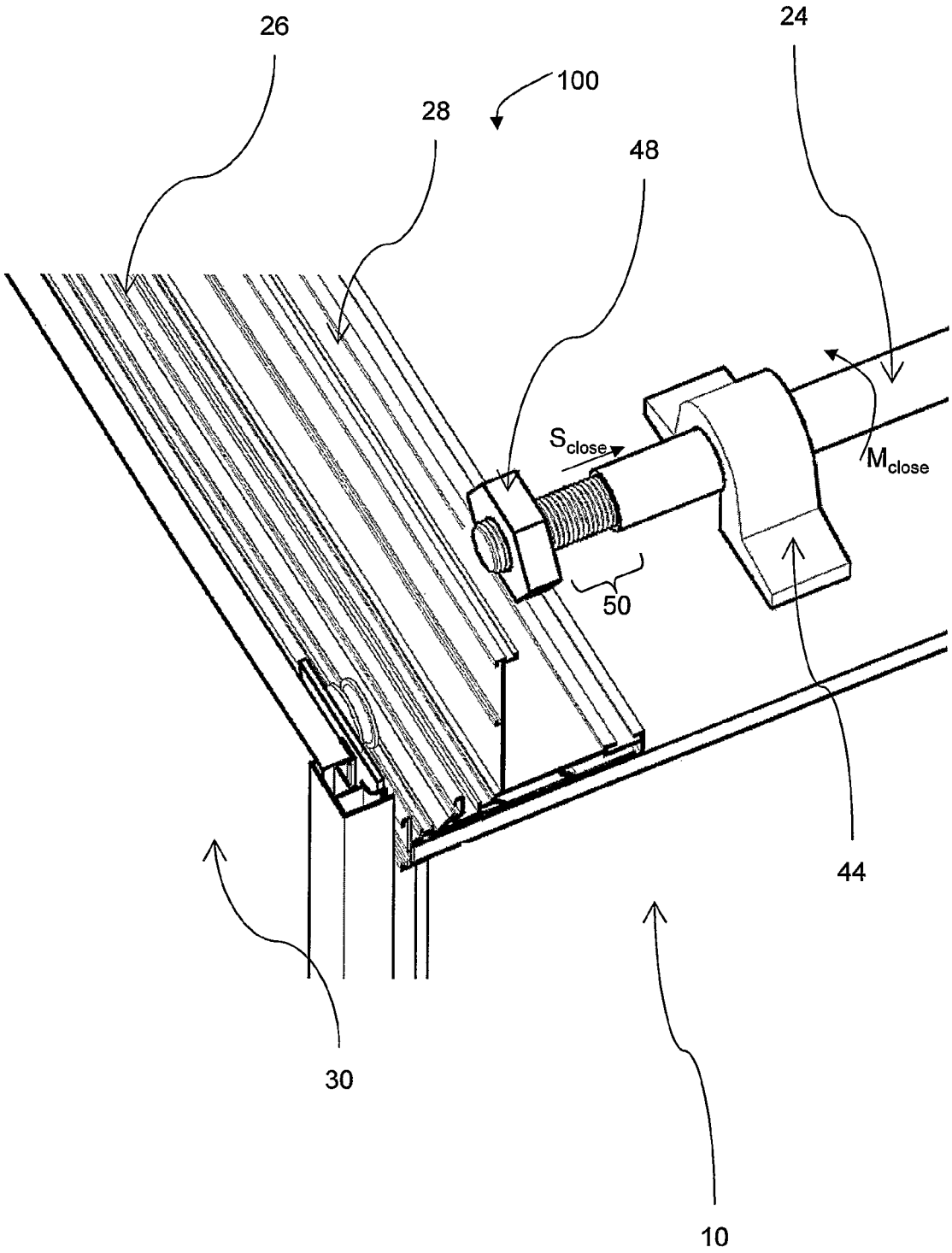
FIG. 4 is a detailed isometric view of the position of guide rails when door surfaces that face the outside of the cabinet are not flush, according to an embodiment of the invention.
Figure 8:
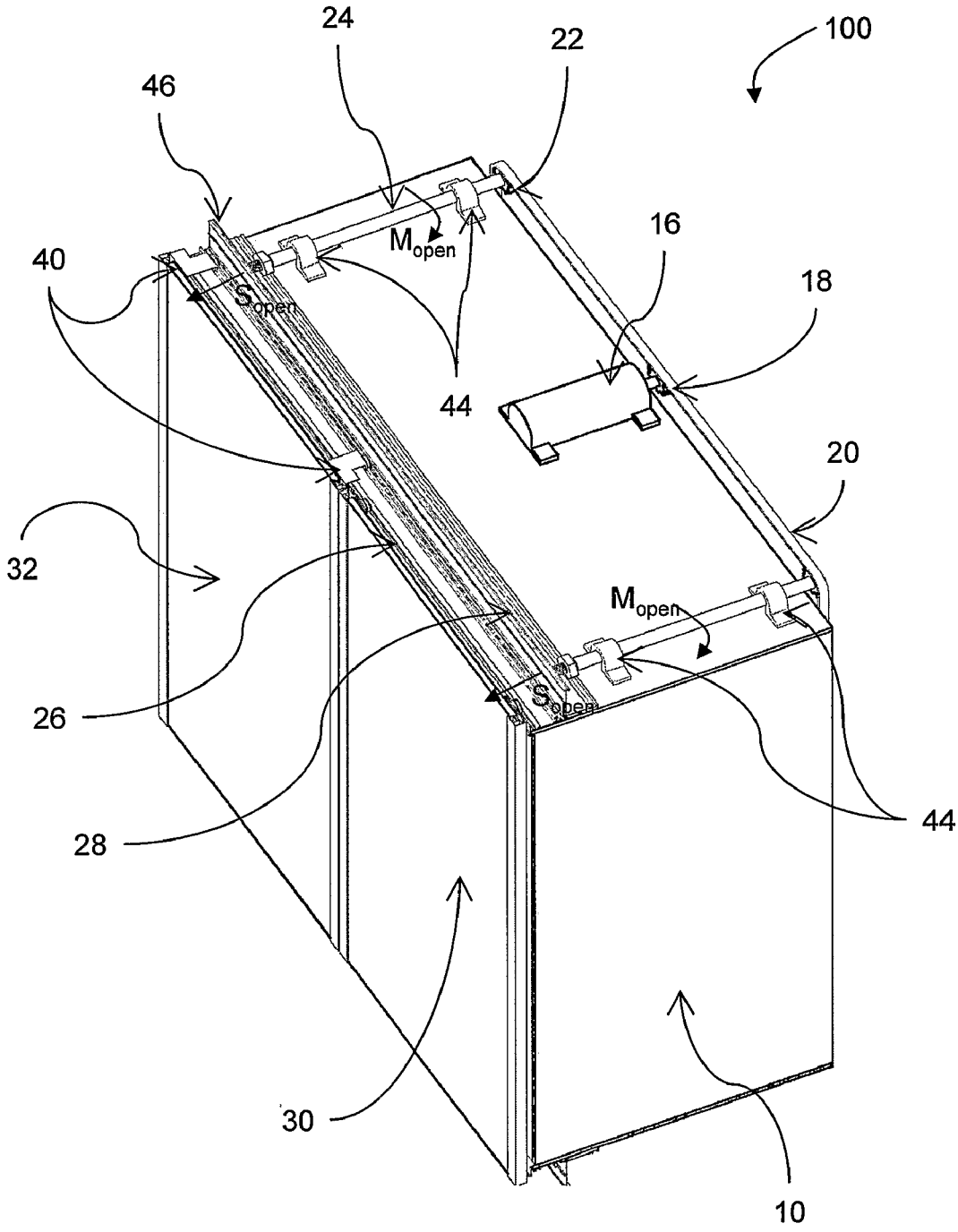
FIG. 8 is an isometric view of the sliding door system of the cabinet closed by the sliding doors and wherein surfaces thereof facing the outside of the cabinet are substantially flush, according to an embodiment of the invention.
Figure 9:
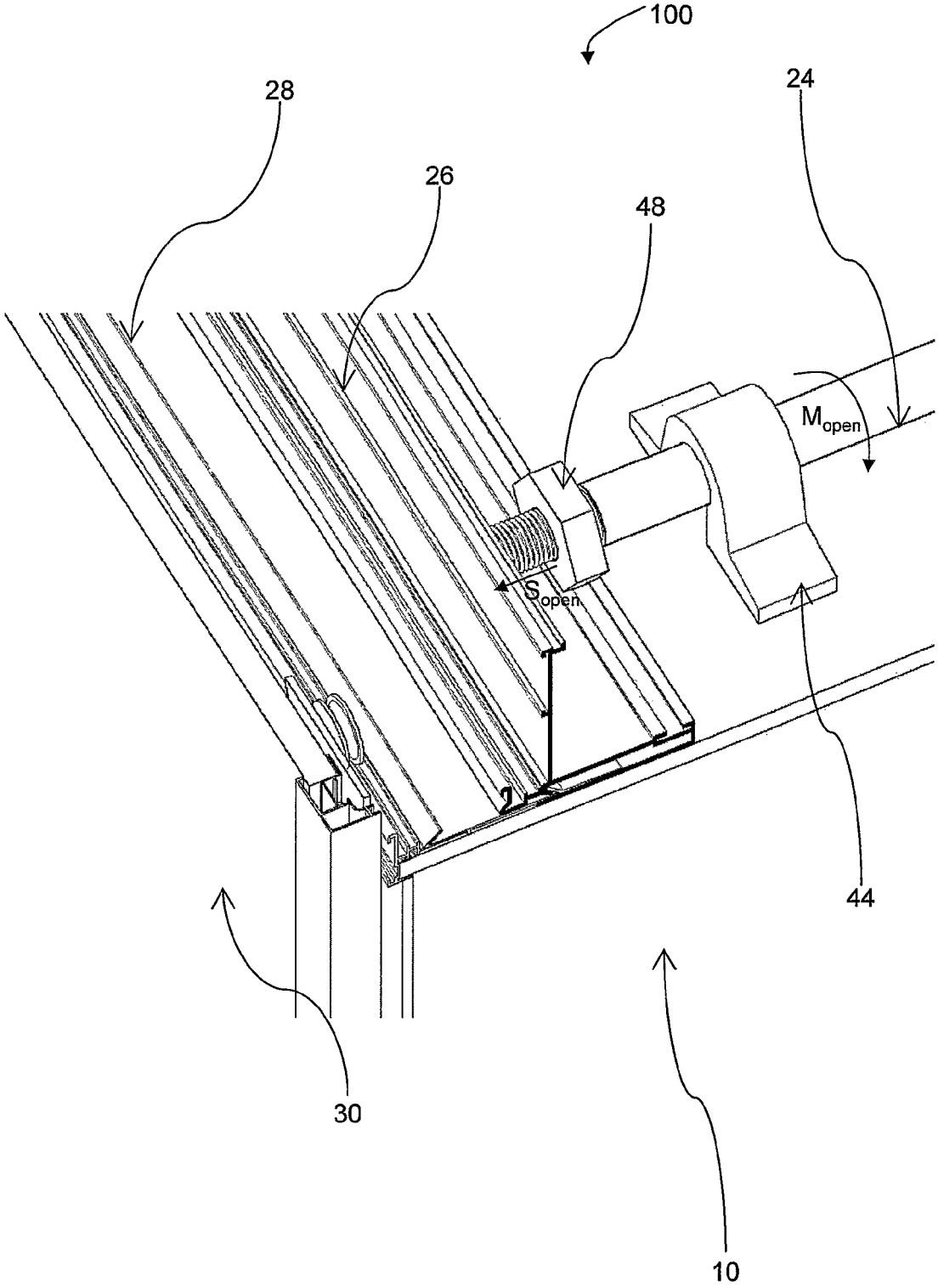
FIG. 9 is a detailed isometric view of the position of the guide rails when door surfaces that face the outside of the cabinet are substantially flush, according to an embodiment of the invention.

Reference is now made to FIG. 1, which is a detailed side view of a sliding door system 100 affixed on a cabinet 10, according to an embodiment of the invention; and to FIG. 2, which is an isometric view of the sliding door system 100 affixed on cabinet 10 closed by sliding doors 30 and 32 and wherein surfaces thereof that face the outside of cabinet 10 are not flush, according to an embodiment of the invention;

Additional reference is made to FIG. 3, which is an isometric view of sliding door system 100 affixed on cabinet 10 opened by sliding doors 30 and 32, wherein surfaces thereof that face the outside of cabinet 10 are not flush, according to an embodiment of the invention; and to FIG. 8, which is an isometric view of sliding door system 100 affixed on cabinet 10 closed by the sliding doors and wherein surfaces thereof facing the outside of cabinet 10 are substantially flush, according to an embodiment of the invention;

According to an embodiment of the invention, sliding door system 100 is affixed to cabinet 10, which may be equipped with at least an inner and an outer sliding door 30 and 32, respectively. The pair of sliding doors 30 and 32 is mechanically coupled to corresponding pairs of guide rails 26 and 28 by a hanging hardware 40 and 42, respectively, wherein together in the closed position, inner and outer sliding doors 30 and 32 are large enough to cover the opening of cabinet 10. Sliding door system 100 may further include a drive 16 mounted, for example, on cabinet 10, and mechanically coupled to one or more rods 24. Rods 24 may be, for example, belt driven, cogwheel driven or driven by other suitable means to enable moving outer guide rails 28 longitudinally towards and away from the opening of cabinet 10, as will be outlined in detail below. Drive 16 may be operated manually, hydraulically, electrically, pneumatically or by other suitable means.

For example, rod 24 may be mechanically coupled to a handle (not shown) enabling the user to selectably rotate rods 24 as schematically indicated with arrows $M_{close}$ and $M_{open}$, thereby causing outer sliding door 32 to move as schematically indicated with arrows $S_{close}$ and $S_{open}$, respectively. In an embodiment of the invention, rotational directions schematically indicated by $M_{close}$ and $M_{open}$ may conform to a right-handed system as is known in the art.

Cabinet 10 may be of any sort, including inter alia, closets, medicine cabinets, kitchen cabinets, file cabinets and the like. Furthermore, the system of the present invention is suitable for sliding windows and other types of paired sliding panels.

In an embodiment of the present invention, inner sliding door 30 and outer sliding door 32 may be slidably affixed so as to fit over the opening of cabinet 10. In some alternative embodiments, inner sliding door 30 and outer sliding door 32 may be slidably affixed within the frame of cabinet 10.

In some embodiments of the invention, drive 16 may be mounted on, e.g., the top of cabinet 10. Protruding from drive 16, towards the back of cabinet 10, is a rod with an attached drive gear 18 mechanically coupled thereto. Arranged across the back of cabinet 10 may be four belt gears 22.

In an embodiment of the invention, one belt gear 22 is situated at each corner of cabinet 10. A belt 20, driven by drive 16, is wrapped around drive gear 18 and the plurality of belt gears 22. This arrangement can be seen in FIGS. 2, 3, 7, 8, and 12. In alternative embodiments, where additional belt gears 22 may be used, belt gears 22 may be arranged across the substantially vertical or substantially horizontal edges of cabinet 10. Such an option may be used when cabinet 10 is, for example, of a great width or height and belt 20 may require additional support. In some embodiments of the present invention, a chain may be used rather than a belt 20. In some alternative embodiments, drive 16 may be operated manually, by a handle for example, hydraulically, or by other means.

Attached to each belt gear 22 and extending towards the front of cabinet 10 are one or more rods 24 each having a thread 50 at the forward end. In embodiments of the invention, sliding door system 100 includes at least one anchor 44 for each rod 24 to couple rods 24 to the top of cabinet 10. In some embodiments of the invention, a plurality of anchors 44 is used for securing each rod 24 in place.

An annular device 48, which may be a mortise, a nut and the like, is threaded onto each of threads 50. Threads 50 allow annular device 48 to advance and recede on rods 24, as schematically indicated in FIGS. 1, 4, 7, 6, 8, 9, 11 and 12 with arrows $S_{open}$ and $S_{close}$, respectively. Annular devices 48 are fixedly connected to outer guide rails 28, creating a slidable connection between outer sliding door 32 and rods 24. Annular device 48 recede, as schematically indicated with arrow $S_{close}$ or $S_{open}$, as a result of the rotation of rods 24, as schematically indicated with arrows $M_{close}$ or $M_{open}$, respectively.

Figure 5:
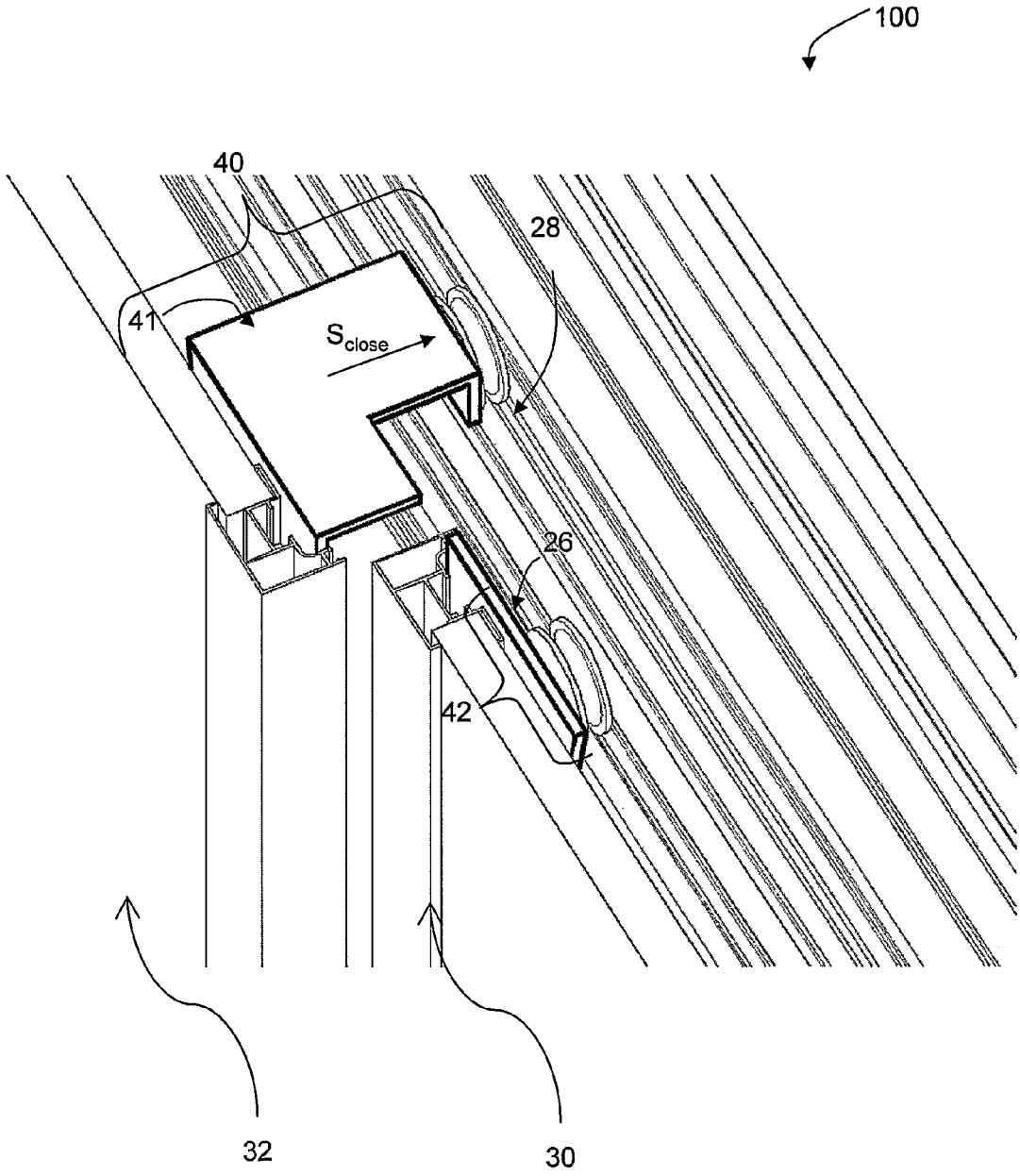
FIG. 5 is a detailed isometric view of the position of a hanging hardware when door surfaces that face the outside of the cabinet are not flush, according to an embodiment of the invention.

As indicated in FIG. 5, inner guide rails 26 provide grooves, along which inner sliding door 30 travels. Inner guide rails 26 are positioned on the upper or the lower or both horizontal surfaces of cabinet 10, inset from and substantially parallel to the front of cabinet 10. Inner guide rails 26 may be of any configuration that will accommodate inner sliding door 30 and inner door hanging hardware 42. Inner guide rails 26 are fixedly attached to the corresponding horizontal surfaces of cabinet 10.

In some embodiments of the invention, inner sliding door 30 of cabinet 10 connects to inner guide rails 26 according the system disclosed in patent WO2004056244, and shown in FIG. 1. In other embodiments, other hanging hardware and/or other hanging systems may be employed.

Inner and outer guide rails 26 and 28 have grooves along which inner and outer sliding doors 30 and 32 travel, respectively. Inner and outer guide rails 26 and 28 are positioned on the upper substantially horizontal surface, the lower substantially horizontal surfaces, or both substantially horizontal surfaces of cabinet 10. Outer guide rails 28 are substantially parallel to inner guide rails 26. Outer guide rails 28 may be of any configuration that will accommodate outer sliding door 32 and the outer door hanging hardware 40. Outer guide rails 28 are mechanically coupled to the corresponding annular devices 48. In some embodiments of the invention, outer sliding door 32 is hung on cabinet 10 according the system disclosed in patent WO2004056244. Other hanging hardware and/or other hanging systems may also be employed.

Figure 10:
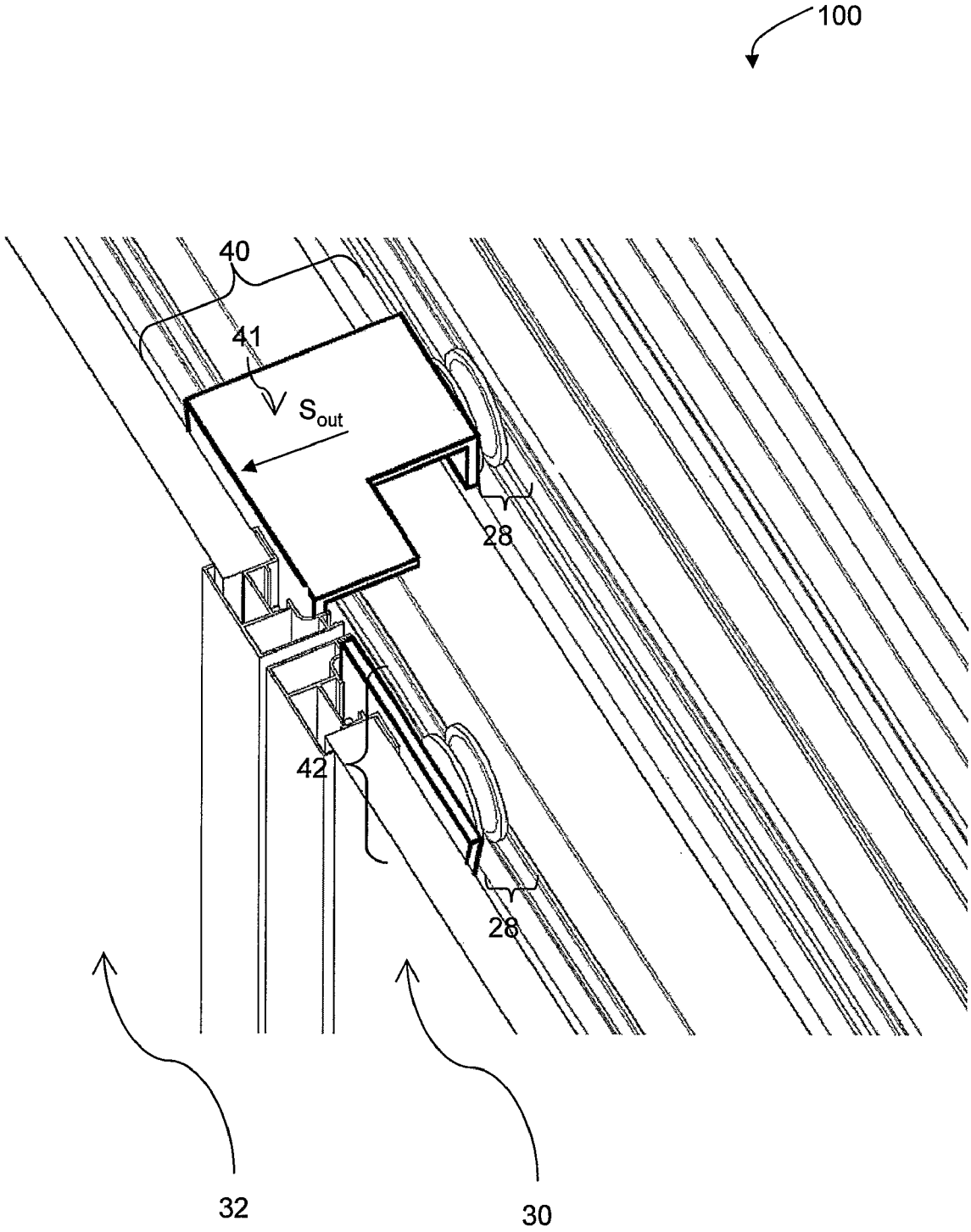
FIG. 10 is a detailed isometric view of the position of the hanging hardware when door surfaces that face the outside of the cabinet are substantially flush, according to an embodiment of the invention.
Figure 11:
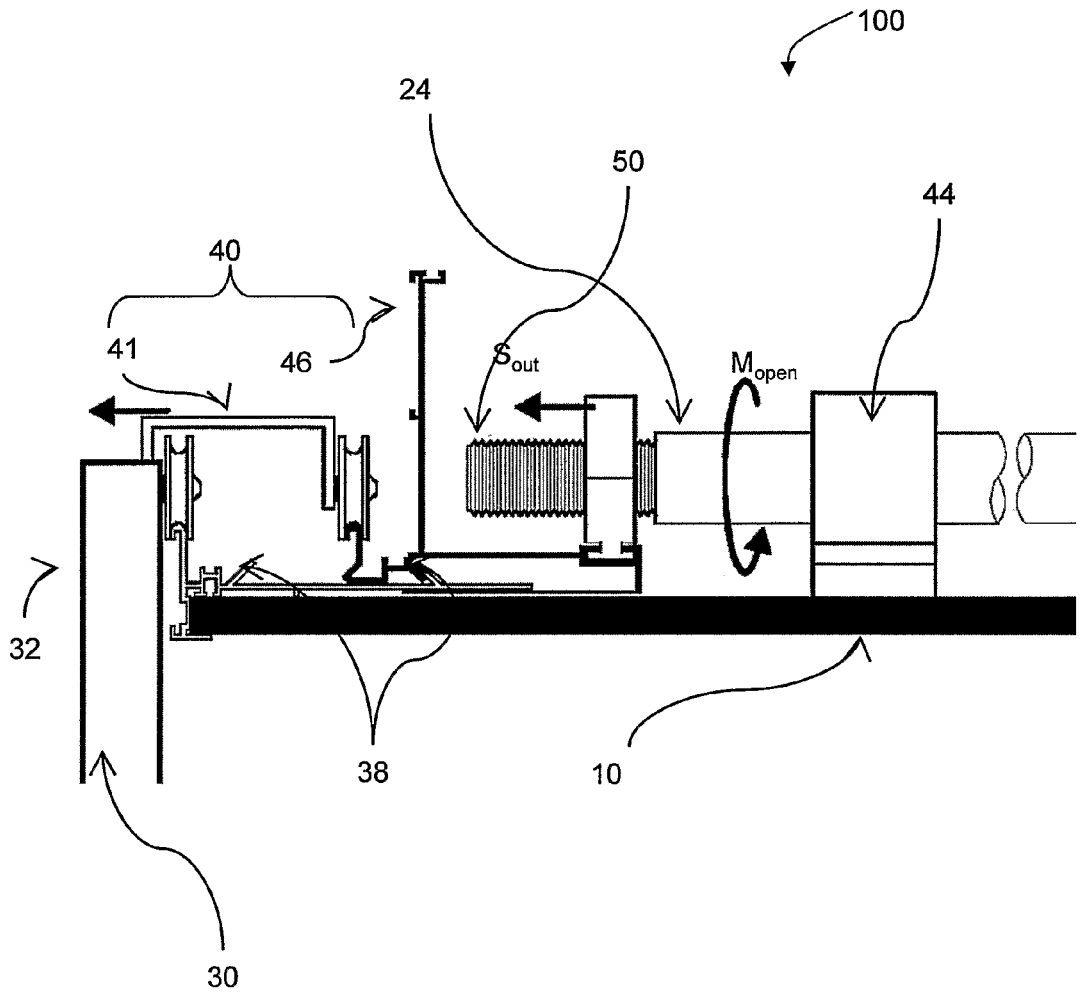
FIG. 11 is a detailed schematic side view of the sliding door system when door surfaces that face the outside of the cabinet are substantially flush, according to an embodiment of the invention.
Figure 12:
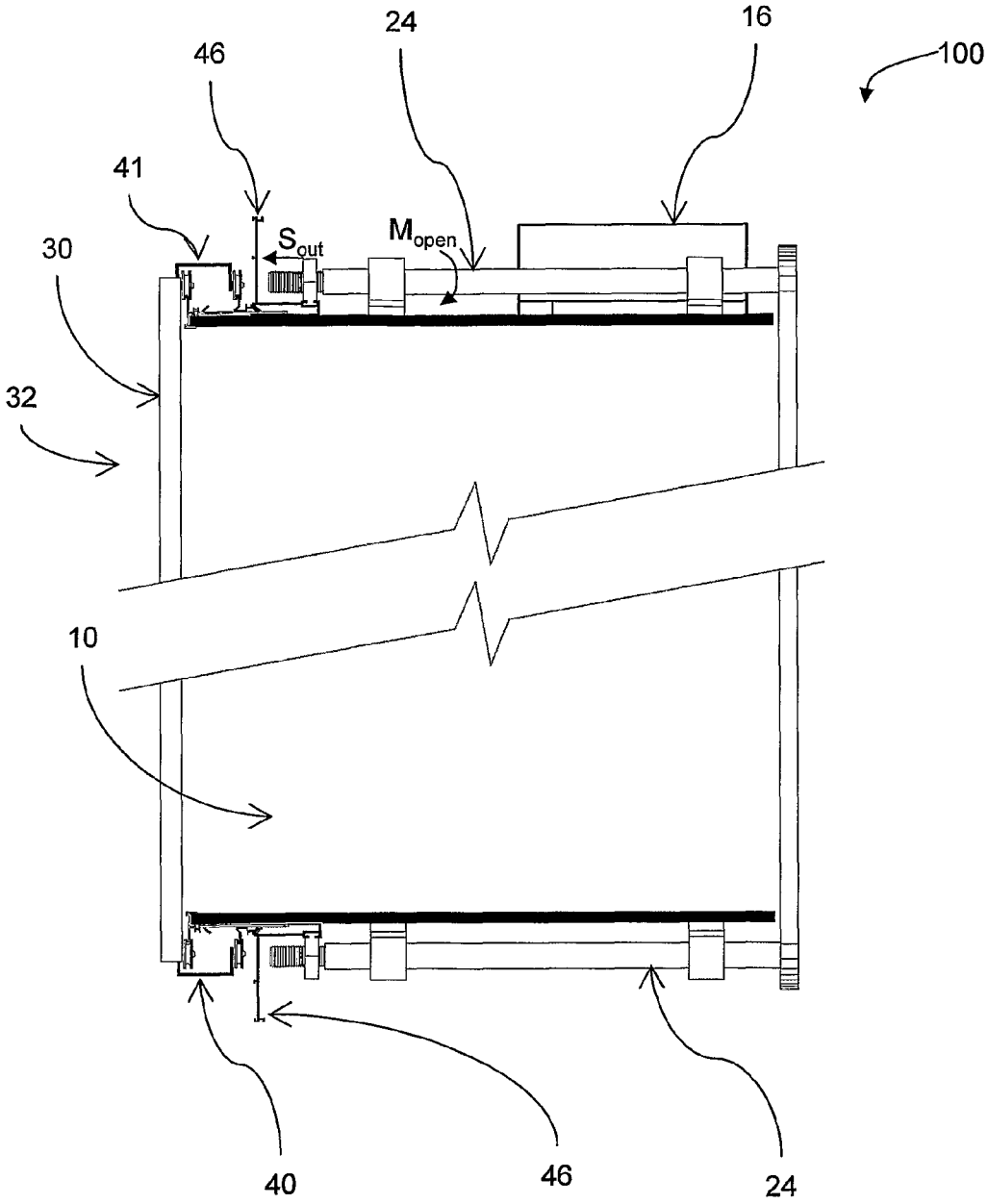
FIG. 12 is another schematic side view of the sliding door system of the cabinet when door surfaces that face the outside of the cabinet are substantially flush, according to an embodiment of the invention.

In an embodiment of the invention, outer door hanging hardware 40 may include, for example, a bridge element 41, as schematically depicted in FIGS. 1, 5, and 10. Bridge element 41 enables outer door hanging hardware 40 to extend up and over inner door hanging hardware 42 and inner door 30 before connecting to outer sliding door 32.

According to some embodiments of the invention, an activation switch for activating or operating drive 16 may be located on the inside vertical surface of cabinet 10, substantially aligned with the outer edge of outer sliding door 32. The activation switch is activated by outer sliding door 32, when the outer edge of outer sliding door 32 makes contact with the corresponding edge of cabinet 10, thereby closing the activation switch. Once the activation switch is closed, drive 16 may be activated to propel outer guide rails 28 forward to substantially the same plane as inner guide rails 26.

Covers 46 may be optionally utilized in order to both conceal guide rails 26 and 28 and any hanging hardware and provide a finished look to cabinet 10. In some embodiments of the present invention, cover 46 is incorporated into outer guide rails 28. In some alternative embodiments, covers 46 may be separate components.

In order to more fully describe the present invention, the following describes an embodiment of a mode of use.

In one embodiment of the invention, inner doors 30 and outer sliding doors 32 of cabinet 10 are moved manually between the opened and closed position. In another embodiment of the invention, inner doors 30, outer sliding doors 32, or both are moved automatically between the opened and closed position by drive 16.

In some embodiments of the invention, sliding door system 100 may be equipped with an input unit (not shown) operatively associated with drive 16. The input unit may be, for example, a remote control operating device, an optical device, a voice recognition device, e.g., as is known in the art. When inner and outer sliding doors 30 and 32 are closed, a user may cause drive 16 to be activated by providing, for example, a suitable input via the input unit.

Activating drive 16 rotates gear 28, which in turn causes belt 20 to rotate, and belt 20 rotates belt gears 22. The rotation of belt gears 22 turns rods 24. As rods 24 turn, they are further threaded onto annular devices 48. This movement is described schematically in FIGS. 4, 6, 9, and 11, with arrows $S_{in}$, $S_{out}$ and $M_{in}$ and $M_{out}$, respectively. Because rods 24 are anchored to cabinet 10, annular devices 48 move along rods 24, forcing outer guide rails 28, outer hanging hardware 40, and outer sliding door 32 to travel in towards the face of cabinet 10. Bridge element 41 allows outer hanging hardware 40 to move without interference from inner hanging hardware 42.

In alternative embodiments, other mechanisms may be used to link drive 16 to rods 24 such that, for example, rods 24 move longitudinally instead of rotating.

Figure 6:
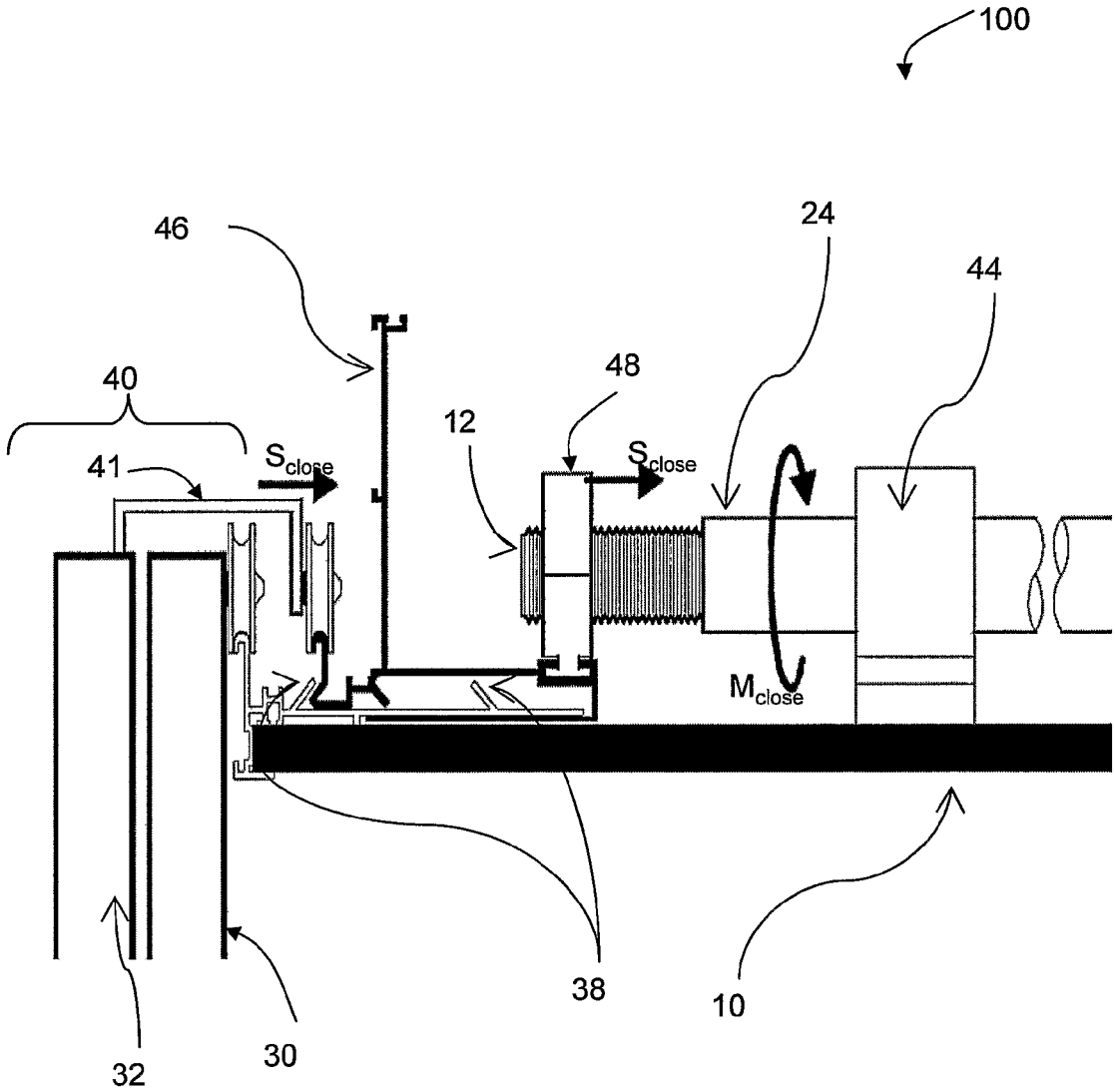
FIG. 6 is another detailed schematic side view of the sliding door system when door surfaces that face the outside of the cabinet are not flush, according to an embodiment of the invention.
Figure 7:
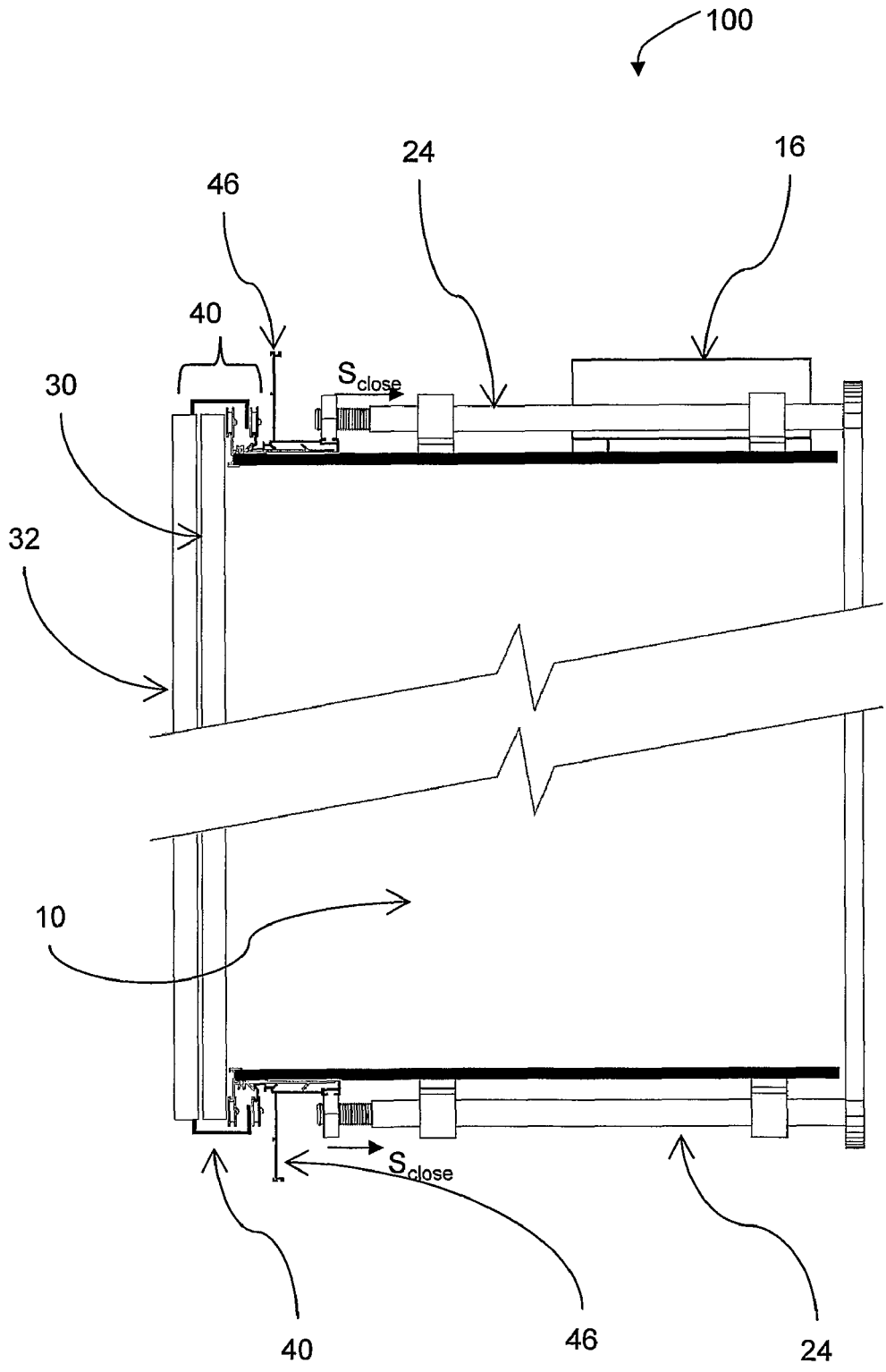
FIG. 7 is another schematic side view of the sliding door system in which the door surfaces are not flush, according to an embodiment of the invention.

Sliding door system 100 may be equipped with safety stops 38 operatively associated with drive 16 such that engaging safety stops 38 causes deactivation of drive 16. Safety stops 38 are engaged when outer guide rails 28 have traveled into substantially the same plane as inner guide rails 26, as seen in FIG. 6.

Once sliding doors 30 and 32 are in the closed position and situated on substantially the same plane, cabinet 10 is quite secure because the input unit is required to reactivate drive 16 to move outer guide rails 28 from substantially the same plane as inner guide rails 26 back to the substantially parallel plane.

In some embodiments of the invention, interlocking safety stops 38 act to prevent outer sliding door 32 from traveling too far in either direction.

Interlocking safety stops 38 may be any type of device that limits or checks the movement of outer guide rails 28.

It is to be understood that retracting outer sliding door 32 such that surfaces facing the outside of cabinet 10 are substantially flush, is only possible when sliding doors 30 and 32 are not superposed.

Figure 13:
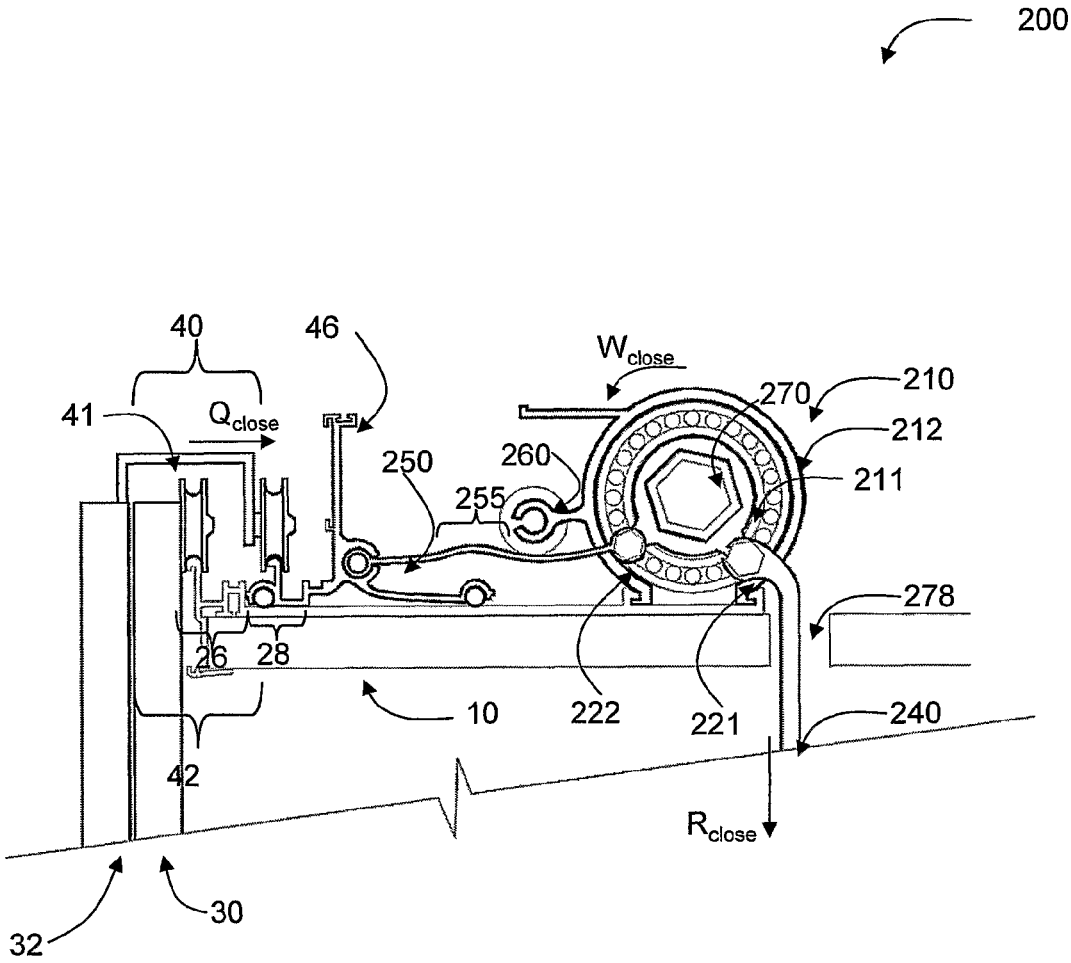
FIG. 13 is a detailed schematic side view of the position of a sliding door system when door surfaces that face the outside of the cabinet are not flush, according to another embodiment of the invention.
Figure 14:
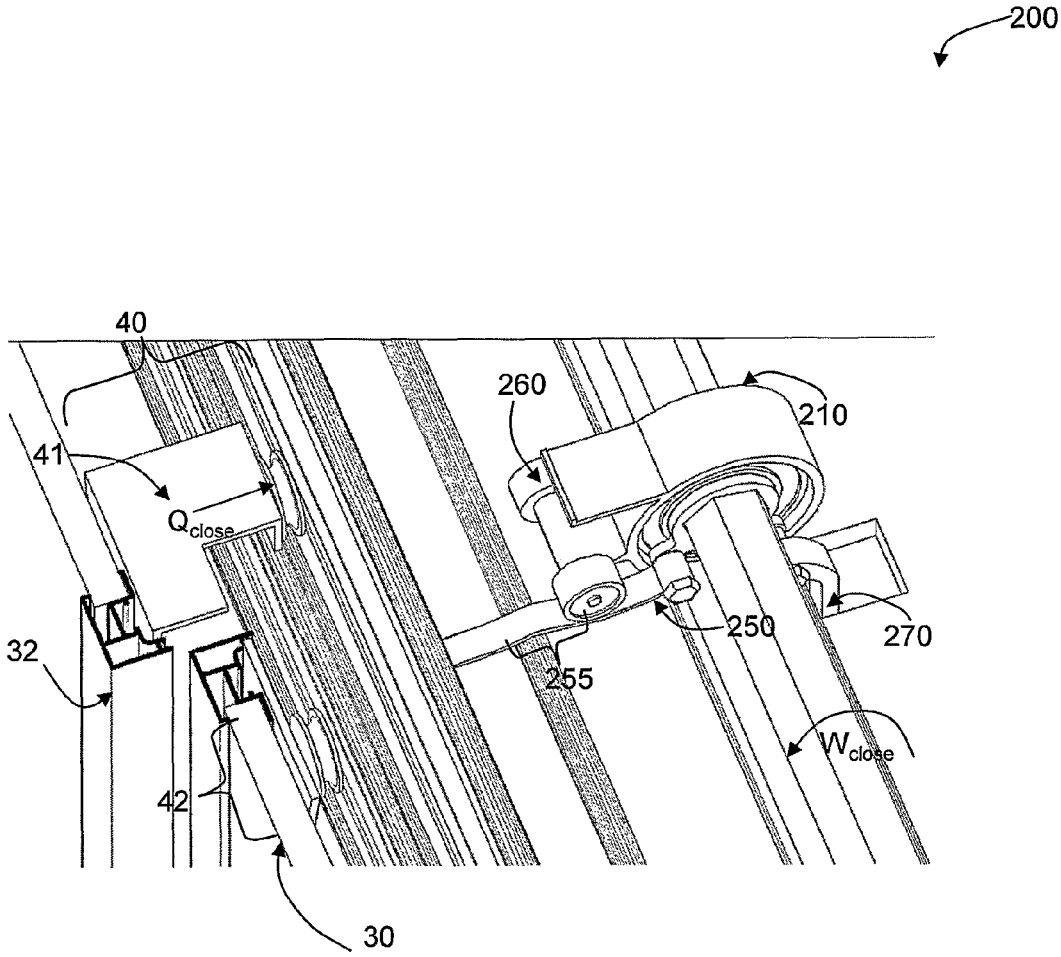
FIG. 14 is a detailed isometric view of the position of the sliding door system when door surfaces that face the outside of the cabinet are not flush, according to the embodiment of FIG. 13.

Reference is now made to FIG. 13, which schematically illustrates a detailed side view of the position of a sliding door system 200 when door surfaces that face the outside of the cabinet 10 are not flush, according to another embodiment of the invention; and to FIG. 14, which schematically illustrate a detailed isometric view of the position of sliding door system 200 when door surfaces that face the outside of the cabinet are not flush, according to the embodiment of FIG. 13.

According to some embodiments of the invention, sliding door system 200 includes one or more bearings 210 (e.g., ball bearings) having inner and outer rings 211 and 212, respectively. Each inner ring 211 of bearings 210 is adapted to securely hold therein a rod 270, which may have, for example, a polygonal cross-section. Outer rings 212 of bearings 210 are affixed on cabinet 10. Bearings 210 are substantially aligned to each other on the top of cabinet 10 in a manner that enables rod 270 to be inserted into inner rings 211 of bearings 210.

According to some embodiments of the invention, a rod 240 and a rod 250 are rotatably coupled via fasteners 221 and 222, respectively, to at least one of inner rings 211. Fasteners 221 and 222 may be, for example, bolts, pins, screws and the like. In an embodiment of the invention, rods 240 and 250 are rotatably coupled to an inner ring 211 that is aligned substantially to the center of the front of cabinet 10. However, it is to be understood that other coupling configurations may be employed. For example, in an embodiment of the invention, two pairs of rods 240 and 250 are connected to each of two inner rings 211 of respective bearings 210.

Rod 250 extends towards outer guide rails 28 and is mechanically coupled thereto. Rod 240 is passed through an aperture 278 in cabinet 10 and rotatably coupled to rod 240 and from there to a displacement drive 290. Displacement drive 290 may be operated manually, electrically, hydraulically, pneumatically and the like. Displacement drive 290 is located inside cabinet 10, as will be outlined below with reference to FIG. 15.

For example, rod 240 may be mechanically coupled to a handle (not shown) enabling the user to selectably move rod 240 into the direction of $R_{close}$ or $R_{open}$.

Figure 15:
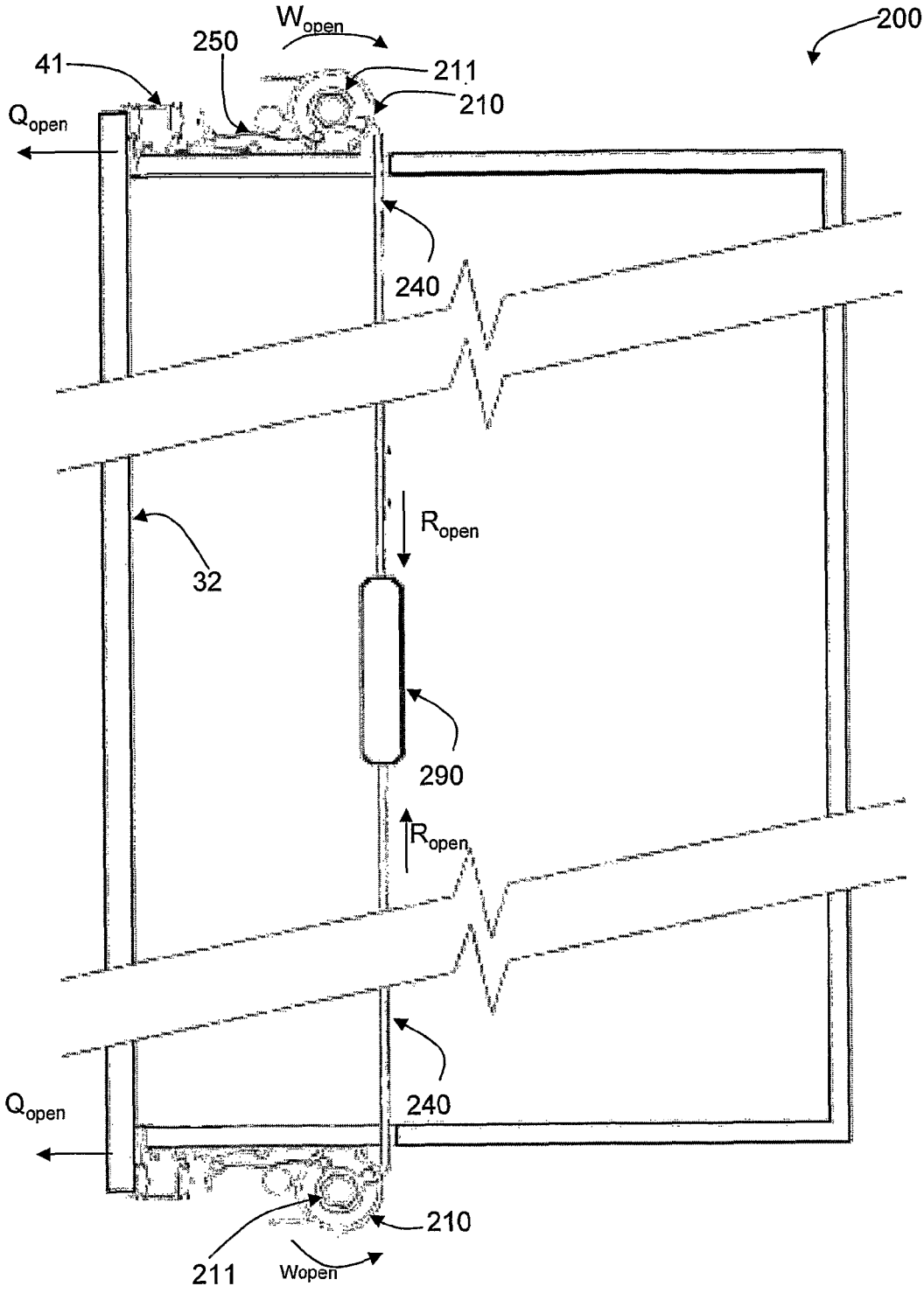
FIG. 15 is a schematic side view illustration of the position of the sliding door system when door surfaces facing the outside of the cabinet are substantially flush, according to the embodiment of FIG. 13.

Reference is made to FIG. 15, which schematically illustrates a schematic side view illustration of the position of the sliding door system, according to the embodiment of FIG. 13;

According to some embodiments of the invention, when sliding doors 30 and 32 are not in the same plane, activating displacement drive 290 via the input unit (not shown) causes rod 240 to be pulled down as schematically indicated with arrow $R_{close}$. As a consequence, inner rings 211 are interconnected by rod 270, rotate within bearing 210 as schematically illustrated with arrow $W_{close}$. In turn, rod 250 causes outer guide rails 28 to retract, as schematically indicated with arrow $Q_{close}$, thereby causing outer sliding door 32 to move into substantially the same plane as sliding door 30. As a result, surfaces that face the outside of cabinet 10 are substantially flush and cabinet 10 is secured. It is to be understood that retracting outer sliding door 32 is only possible when doors 30 and 32 are not superposed.

Sliding door system 200 is adapted to prevent upward movement of the end of rod 250 that is coupled to outer guide rails 28, during the rotation of inner ring 211 as schematically indicated with arrow $W_{close}$. In some embodiments, bearing 210 is equipped with a protrusion 260 protruding approximately in alignment with rod 250 towards guide rails 28. In addition, rod 250 has an upwardly bent portion 255. Therefore, when inner ring 211 rotates around its axis as schematically indicated with arrow $W_{close}$, the bent portion 255 is pressed against protrusion 260, thereby preventing rod 250 from moving in an upward direction. This prevents the detachment of outer guide rail 28 from the top of cabinet 10. Other configurations may be possible in preventing rod 250 from moving upwards. For example, rod 250 may be confined within a substantially U-shaped guide element that is fixedly connected at its ends to the top cover of cabinet 10.

Figure 16:
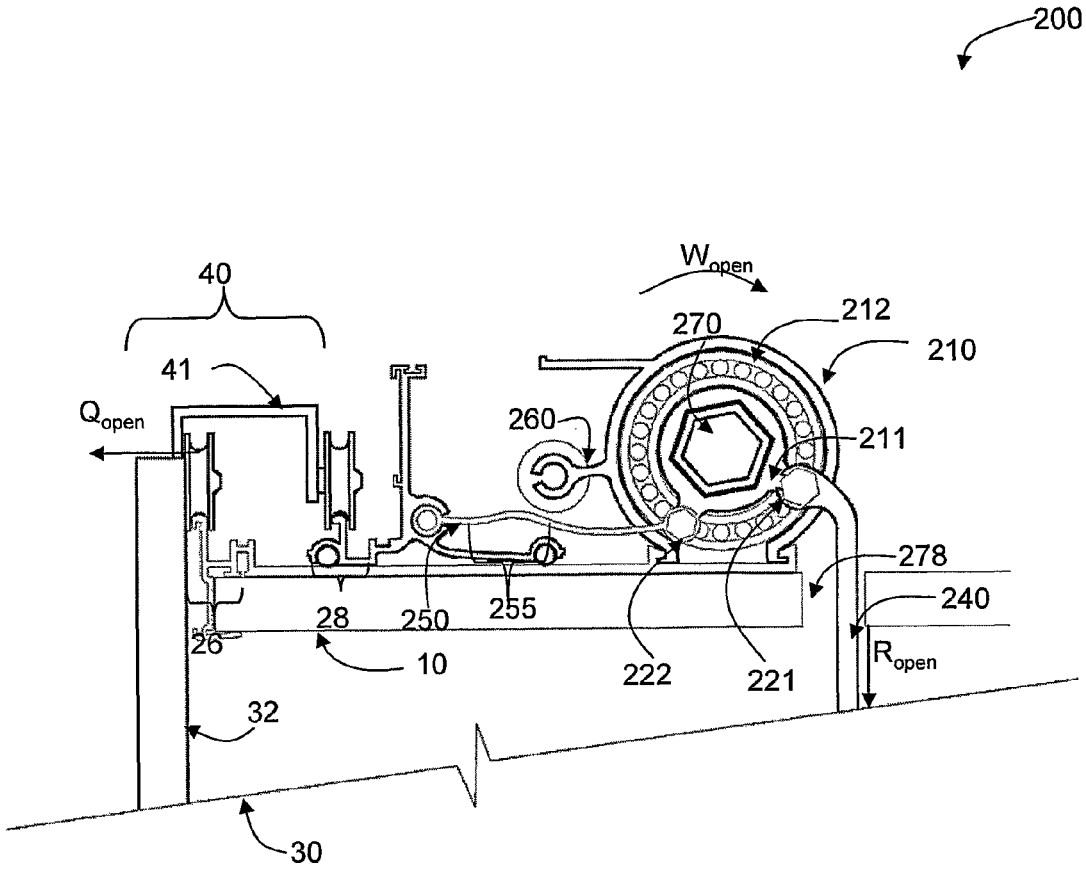
FIG. 16 is a detailed schematic illustration of the position of the sliding door system when door surfaces facing the outside of the cabinet are substantially flush, according to the embodiment of FIG. 13.
Figure 17:
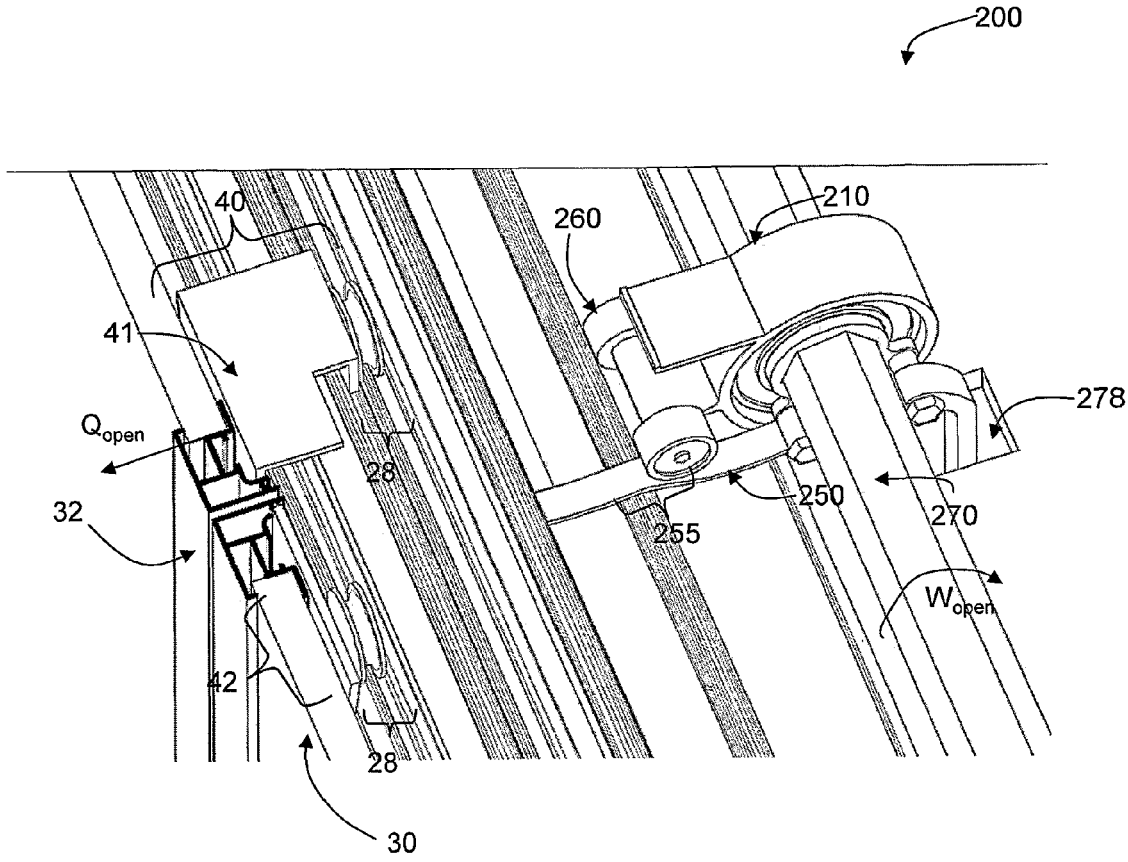
FIG. 17 is a detailed isometric view of the position of the sliding door system when door surfaces facing the outside of the cabinet are substantially flush, according to the embodiment of FIG. 13.

Further reference is made to FIG. 16, which schematically illustrates a detailed schematic illustration of the position of the sliding door system when door surfaces facing the outside of cabinet 10 are substantially flush, according to the embodiment of FIG. 13; and to FIG. 17, which schematically illustrates a detailed isometric view of the position of sliding door system 200 when door surfaces facing the outside of cabinet 10 are substantially flush, according to the embodiment of FIG. 13;

In an embodiment of the invention, when sliding doors 30 and 32 are in substantially the same plane (i.e. surfaces facing the outside of cabinet 10), displacement drive 290 is configured such that an activation thereof causes sliding door 32 to move away from the opening of cabinet 10. When sliding door 32 is moved away from the opening of cabinet 10, (i.e., sliding door 32 and sliding door 30 are not in the same plane), sliding door 30 and/or sliding door 32 can slide within guide rail 26 and/or 28, respectively.

The activation or operation of displacement drive 290 causes rod 240 to move downward towards displacement drive 290, as schematically indicated with arrow $R_{open}$. The downward movement of rod 240 causes inner ring 211 to rotate around its axis within bearing 210, as schematically indicated with arrow $W_{open}$. In turn, rod 250 is pushed by inner ring 211 to the direction of sliding door 32, thereby sliding outer rail guide 28 in the direction of the opening of cabinet 10. As a result, outer sliding door 32 moves away from the plane of sliding door 30, thereby enabling the opening of cabinet 10.

Additionally or alternatively, the lower edge of sliding door 32 is mechanically coupled to displacement drive 290, whereby the coupling is configured substantially like the coupling of the upper edge of sliding door 32, with displacement drive 290.

When door surfaces facing the outside of cabinet 10 are substantially flush, an activation of displacement drive 290 causes rod 240 to move as schematically indicated with arrow $R_{open}$. In turn, inner rings 211 rotate as schematically illustrated with arrows $W_{open}$, thereby pushing rod 250, now mechanically coupled to sliding door 32, outwardly. As a result, sliding doors 30 and/or 32 and may slide freely within inner and outer guiding rails 26 and/or 28, respectively.

Figure 18A:
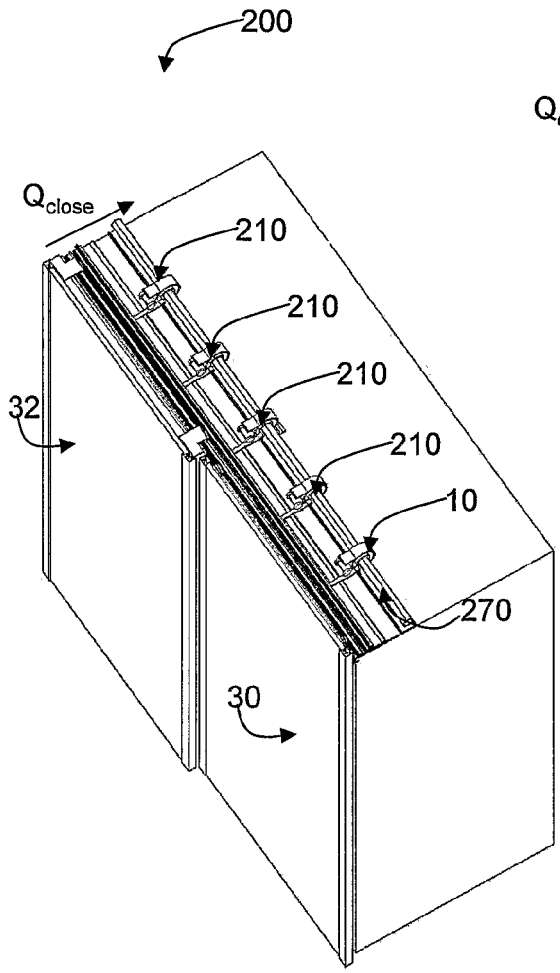
FIG. 18*a* is an isometric illustration of the sliding door system of the cabinet, which is adapted to be closed by the sliding doors, wherein outer door surfaces are not flush, according to the embodiment of FIG. 13.
Figure 18B:
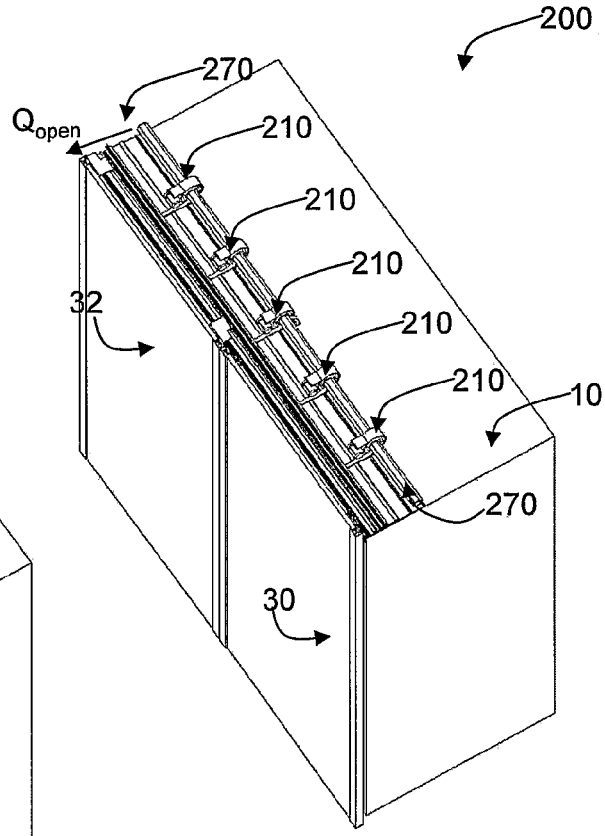
FIG. 18*b* is an isometric illustration of the sliding door system of the cabinet, which is adapted to be closed by the sliding doors, wherein outer door surfaces are substantially flush, according to the embodiment FIG. 13.

FIG. 18*a* is an isometric illustration of the sliding door system of cabinet 10, which is adapted to be closed by the sliding doors, wherein outer door surfaces are not flush, according to the embodiment of FIG. 13; and FIG. 18*b* is an isometric illustration of the sliding door system of cabinet 10, which is adapted to be closed by the sliding doors, wherein outer door surfaces are substantially flush, according to the embodiment FIG. 13.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. A system for sliding doors of a cabinet comprising:

at least one pair of guide rails, said pair comprising an inner guide rail and an outer guide rail, each said guide rail connects to an inner sliding door and an outer sliding door respectively;

at least one sliding door mechanism operatively connected to at least one of said guide rails, said sliding door mechanism allows selectably moving at least one of said guide rails between a first and a second positions, wherein in said first position the outer and inner sliding doors are located at different planes to enable sliding of the outer and inner sliding doors along said guide rails, and wherein in said second position surfaces of said outer and inner sliding doors are substantially coplanar; and an inner and an outer hanging hardware, wherein said inner hanging hardware couples said inner sliding door to said inner guide rail and said outer hanging hardware couples said outer sliding door to said outer guide rail, said outer hanging hardware comprises a bridge element that extends above and over said inner door and said inner guide rail.

2. The system of claim 1 further comprising a support onto which said sliding door mechanism is mounted said support is locatable at a top of said cabinet.

3. The system of claim 2, wherein said mechanism comprises:

at least one rod rotatably affixed to said support, said rod having a thread; and an annular device threaded onto said thread, wherein said annular device is fixedly adjusted to said outer guide rail; wherein rotation of said rod causes longitudinal displacement of said annular device along said thread, thereby causing a longitudinal displacement of said outer door.

4. The system of claim 3, wherein the direction of movement of said annular device in said thread depends on the direction of rotation of said rod.

5. The system of claim 3 further comprising at least one displacement drive operatively connecting to said at least one sliding door mechanism in a manner that allows operating said sliding door mechanism for moving at least one of said sliding doors from one of said positions to another wherein said rod is rotated by a drive.

6. The system of claim 5, wherein said displacement drive connects to at least one of the following group: a) a belt drive; and b) a cogwheel drive wherein said belt drive comprises at least one belt wrapped around said displacement drive.

7. The system of claim 5, wherein said displacement drive is at least one of the following: a) manual; b) electrical; c) pneumatic; and d) hydraulic.

8. The system of claim 5, further comprising an activation switch, which is operatively associated with said displacement drive to allow said drive to move said sliding doors from said one position to another by operating said switch.

9. The system of claim 1, wherein said inner and outer guide rails comprise grooves.

10. The system of claim 1, wherein said inner and outer guide rails are substantially parallel to each other.

11. The system of claim 1, wherein said sliding door mechanism comprises:

a) at least one bearing having an inner and an outer ring;

b) a first rod suitably coupled to a displacement drive and rotatably connected to said inner ring; and c) a second rod suitably coupled to said outer guide rails and rotatably connected to said inner ring; wherein operating said displacement drive enables the rotation of said inner ring to selectably move said outer sliding door to said first and said second position.

12. The system of claim 11, wherein inner rings of a plurality of said bearings securely hold therein at least one other rod thereby enabling said displacement drive to rotate said plurality of bearings.

13. The system of claim 11, wherein said bearing has a protrusion substantially aligned with said second rod to confine upward movement of said second rod, thereby preventing detachment of said outer guide rail from said support.

14. The system of claim 11, wherein said displacement drive is at least one of: a) manual; b) electrical; c) pneumatic; and d) hydraulic.

15. The system of claim 11, wherein said displacement drive enables selectable displacement of said first rod into a closing and opening position, wherein:

a) the displacement of said first rod into said closing position causes said inner ring to rotate in a direction causing said second rod and said outer guide rail which is connected thereto to retract into said second position; and b) the displacement of said first rod into said opening position causes said inner ring to rotate in a direction causing said second rod and said outer guide rail to be pushed outwardly into said first position.

16. The system of claim 1 comprises at least one upper sliding door mechanism locatable at an upper side of said cabinet and at least one lower sliding door mechanism locatable at a lower side of said cabinet, wherein each pair of an upper and lower sliding door mechanisms are operatively connected through a displacement drive, said displacement drive allows operating said respective pair of sliding door mechanisms for moving at least one of said sliding doors from one of said positions to another.

17. The system of claim 16, wherein a first connecting means rotatably connects said displacement drive to said upper sliding door mechanism and a second connecting means connects said displacement drive to the lower sliding door mechanism in a manner that allows said displacement drive to rotate said first connecting means in a first rotation direction and said second connecting means in a second rotation direction opposite to said first rotation direction to allow simultaneous moving of said upper and lower sliding door mechanisms in the same direction for moving of said respective sliding door.

* * * * *